US011329403B2

(12) United States Patent
Koellmann

(10) Patent No.: US 11,329,403 B2
(45) Date of Patent: May 10, 2022

(54) CONDUCTOR CONNECTION TERMINAL

(71) Applicant: WAGO Verwaltungsgesellschaft mbH, Minden (DE)

(72) Inventor: Hans-Josef Koellmann, Minden (DE)

(73) Assignee: WAGO Verwaltungsgesellschaft mbH, Minden (DE)

( * ) Notice: Subject to any disclaimer, the term of this patent is extended or adjusted under 35 U.S.C. 154(b) by 0 days.

(21) Appl. No.: 17/176,877

(22) Filed: Feb. 16, 2021

(65) Prior Publication Data

US 2021/0257753 A1 Aug. 19, 2021

(30) Foreign Application Priority Data

Feb. 17, 2020 (DE) ..... 20 2020 100 839.0

(51) Int. Cl.
*H01R 4/48* (2006.01)
*H01R 9/24* (2006.01)
*H01R 13/502* (2006.01)

(52) U.S. Cl.
CPC ..... *H01R 4/4827* (2013.01); *H01R 4/4818* (2013.01); *H01R 4/4836* (2013.01);
(Continued)

(58) Field of Classification Search
CPC .. H01R 4/4827; H01R 4/4818; H01R 4/4845; H01R 9/2416; H01R 13/502; H01R 4/26;
(Continued)

(56) References Cited

U.S. PATENT DOCUMENTS 7,070,463 B2 7/2006 Arai et al.
7,448,901 B2 11/2008 Weber et al.
(Continued)

FOREIGN PATENT DOCUMENTS

CN 107819226 A 3/2018
CN 207753189 U 8/2018
(Continued)

OTHER PUBLICATIONS

DE102013101830A1 (WAGO Verwaltungsgesellschaft mbH) Jul. 10, 2014, Retrieved from: https://worldwide.espacenet.com/ (Year: 2014).*

*Primary Examiner* — Travis S Chambers
(74) *Attorney, Agent, or Firm* — Muncy, Geissler, Olds & Lowe, P.C.

(57) ABSTRACT

A conductor connection terminal with an insulating material housing, a busbar component, a first clamping leg and a second clamping leg, wherein the first clamping leg and the second clamping leg are arranged on a clamping spring or on different clamping springs, respectively, wherein the first clamping leg and the busbar component form a first clamping point for a first electrical conductor to be clamped, and the second clamping leg and the busbar component form a second clamping point for a second electrical conductor to be clamped, wherein the busbar component comprises a first conductor receiving section and a second conductor receiving section at diametrically opposite areas of one another, wherein the first conductor receiving section and the second conductor receiving section are connected to one another via a connecting section.

14 Claims, 6 Drawing Sheets

(52) U.S. Cl.
CPC ..... *H01R 4/4845* (2013.01); *H01R 9/2416* (2013.01); *H01R 13/502* (2013.01)

(58) Field of Classification Search
CPC ..... H01R 4/4836; H01R 11/09; H01R 11/01; H01R 13/42
See application file for complete search history.

(56) References Cited

U.S. PATENT DOCUMENTS

| | | | | |
|---|---|---|---|---|
| 10,033,119 | B2 | 7/2018 | Koellmann | |
| 11,063,376 | B2 * | 7/2021 | Meyer | H01R 4/4818 |
| 2009/0104816 | A1 * | 4/2009 | Koellmann | H01R 9/26 439/625 |
| 2021/0257752 | A1 * | 8/2021 | Meyer | H01R 9/2416 |

FOREIGN PATENT DOCUMENTS

| | | | | |
|---|---|---|---|---|
| DE | 102013101830 | A1 | 7/2014 | |
| DE | 102014119421 | A1 | 6/2016 | |
| DE | 202016105702 | U1 | 1/2018 | |
| EP | 3460917 | A1 * | 3/2019 | H01R 4/4845 |

* cited by examiner

CONDUCTOR CONNECTION TERMINAL

This nonprovisional application claims priority under 35 U.S.C. § 119(a) to German Patent Application No. 20 2020 100 839.0, which was filed in Germany on Feb. 17, 2020 and which is herein incorporated by reference.

BACKGROUND OF THE INVENTION

Field of the Invention

The present invention relates to a conductor connection terminal with an insulating material housing, a busbar component, a first clamping leg and a second clamping leg, wherein the first clamping leg and the second clamping leg are arranged on a clamping spring or in each case on different clamping springs, wherein the first clamping leg and the busbar component form a first clamping point for a first electrical conductor to be clamped, and the second clamping leg and the busbar component form a second clamping point for a second electrical conductor to be clamped, wherein the busbar component comprises a first conductor receiving section and a second conductor receiving section at diametrically opposite areas of one another, wherein the first conductor receiving section and the second conductor receiving section are connected to one another via a connecting section, wherein the first electrical conductor can be fed to the respective clamping point via the first conductor receiving section in a first conductor insertion direction and the second electrical conductor can be fed to the respective clamping point via the second conductor receiving section in a second conductor insertion direction, and wherein the busbar component has a bottom section comprising the clamping points, a top surface and two opposing side surfaces which connect the bottom section to the top surface.

Description of the Background Art

DE 20 2016 105 702 U1 provides a conductor connection terminal with a contact insert, wherein the contact insert comprises a holding frame. The holding frame is thereby formed from several side walls aligned with one another. One of the side walls is thereby positively connected to another side wall.

SUMMARY OF THE INVENTION

It is therefore an object of the present invention to provide an improved conductor connection terminal.

In an exemplary conductor connection terminal, it is proposed that the first conductor receiving section and the second conductor receiving section are formed to be circumferentially closed, wherein the connecting section has at least one recess within the bottom section.

In this way, a conductor connection terminal is created which ensures current flow and has the necessary stability at the same time. The corresponding recess can save material and at the same time create installation space for additional components. In particular, the busbar component can thereby be made in one piece.

Furthermore, the recess can provide a latching edge on the busbar component. This latching edge can be used, for example, in such a way that one or more latching connections are arranged on the insulating material housing, which enclose the busbar component and latch onto the latching edge of the recess.

The busbar component may have a fastening element for fastening the clamping spring to the busbar component. In particular, the fastening element is designed as a fastening tab.

Thereby, it is conceivable that the clamping spring can be suspended in the fastening tab in a self-supporting manner. This has the advantage that the clamping spring can be attached to the busbar without additional fasteners.

The recess of the connecting section may be arranged substantially central between the first conductor receiving section and the second conductor receiving section.

The recess can extend over the side surfaces. In particular, the recess is U-shaped in a cross section perpendicular to the first conductor insertion direction and/or to the second conductor insertion direction. The U-shaped recess can further save material and provide a higher latching edge.

The top surface can be designed as a conductor run-up chamfer. In particular, the top surface can be V-shaped in a cross section in the direction of the first conductor insertion direction and/or the second conductor insertion direction.

By designing the top surface as a conductor run-up chamfer, existing contours can be used to facilitate the insertion of an electrical conductor. The top surface can thereby be designed to ascend towards the first conductor insertion direction and/or the second conductor insertion direction. This creates a funnel-shaped first and/or second conductor receiving section expanding against the conductor insertion direction for guiding the first electrical conductor and/or the second electrical conductor. The electrical conductors to be clamped can be inserted with a large cross section into the respective conductor receiving section, wherein the cross section tapers towards the respective clamping point, so that the electrical conductors can be securely clamped in the respective clamping points.

The clamping spring may have a contact leg, a clamping leg, and a spring arc arranged between the contact leg and clamping leg, wherein the clamping leg extends towards the busbar component and has a spring clamping edge for clamping the first electrical conductor and/or the second electrical conductor.

A conductor stop can be arranged on the conductor connection terminal for positioning the first electrical conductor to be clamped and/or the second electrical conductor to be clamped, wherein the conductor stop is arranged in the area of the recess. Furthermore, the conductor stop can be arranged on the insulating material housing.

The conductor stop serves to correctly position the electrical conductors to be clamped. The electrical conductors are thereby guided into the conductor connection terminal until they are blocked by the conductor stop. The electrical conductors to be clamped can then be clamped in this position. It is conceivable that a conductor stop is provided for the first electrical conductor to be clamped and for the second electrical conductor to be clamped. Opposite sides of the conductor stop are then assigned to one of the electrical conductors to be clamped, respectively. However, it is also conceivable that a separate conductor stop is assigned to each electrical conductor to be clamped.

In order to provide a conductor stop in a structurally simple manner, it can be arranged on the insulating material housing, wherein the conductor stop engages in the recess of the busbar component. However, it is also possible for the conductor stop to be arranged on the busbar component itself, for example, and to protrude into the recess of the busbar component.

The insulating material housing can be transparent at least in the area of the conductor stop, wherein the conductor stop is visible through the insulating material housing.

By forming a transparent insulating material housing, a check of the insertion depth of the electrical conductors to be clamped is created, wherein the user can actively check by means of the housing whether the respective electrical conductor is positioned at the conductor stop. In this case, it is conceivable that markings are arranged on the busbar component and/or on the insulating material housing, wherein the markings indicate the minimum insertion depth of the first electrical conductor and/or of the second electrical conductor. The minimum insertion depth is the depth at which secure clamping of the electrical conductors to the busbar component can be ensured. Such markings can, for example, take the form of colored markings or indentations.

A test opening can be arranged on the insulating material housing, wherein the test opening is aligned transversely with respect to the first electrical conductor to be clamped and/or transversely to the second electrical conductor to be clamped and extends from the surface of the insulating material housing through the insulating material housing towards the busbar component. By means of such a test opening, the busbar component can be contacted with external measuring devices.

The conductor connection terminal may have an actuating lever, wherein the actuating lever is arranged for deflecting the first clamping leg and/or the second clamping leg. In particular, the conductor connection terminal may have a support surface for the actuating lever.

This enables easy opening and/or closing of the clamping point without any further aids. It is conceivable that the conductor connection terminal has at least two actuating levers, wherein in each case one actuating lever interacts with one of the clamping legs, so that one actuating lever is set up for opening and/or closing a clamping point. The clamping points can then be opened or closed independently of one another. Releasing the electrical conductor from the clamping point is thereby preferably not possible without lever actuation.

The support for the actuating lever enables a closed power flow through the conductor connection terminal, so that selective peak loads can be reduced. The support can be implemented, for example, as a support tab, wherein the support tab is arranged in the first conductor insertion direction or the second conductor insertion direction or a support tab is in each case arranged in each of the two conductor insertion directions upstream of the conductor receiving section. It is conceivable that the support is arranged, for example, on the insulating material housing and/or on the clamping spring and/or on the busbar component. Multiple supports promote improved load distribution, caused by the actuating lever.

The recess can be closed by the insulating material housing. For example, the recess can be closed in such a way that the insulating material housing protrudes into the recess or the insulating material housing is guided past the recess from the outside in direct or indirect proximity.

The undefined term "a" is to be understood as such and not as a numeral. Thus, it is also conceivable that the conductor connection terminal according to the invention has a multitude of busbar components arranged side by side. For example, two, three, four or five busbar components may be arranged side by side in an insulating material housing, wherein the busbar components each have two clamping springs for two electrical conductors to be clamped.

Further scope of applicability of the present invention will become apparent from the detailed description given hereinafter. However, it should be understood that the detailed description and specific examples, while indicating preferred embodiments of the invention, are given by way of illustration only, since various changes, combinations, and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus, are not limitive of the present invention, and wherein.

DETAILED DESCRIPTION

Figure 1:
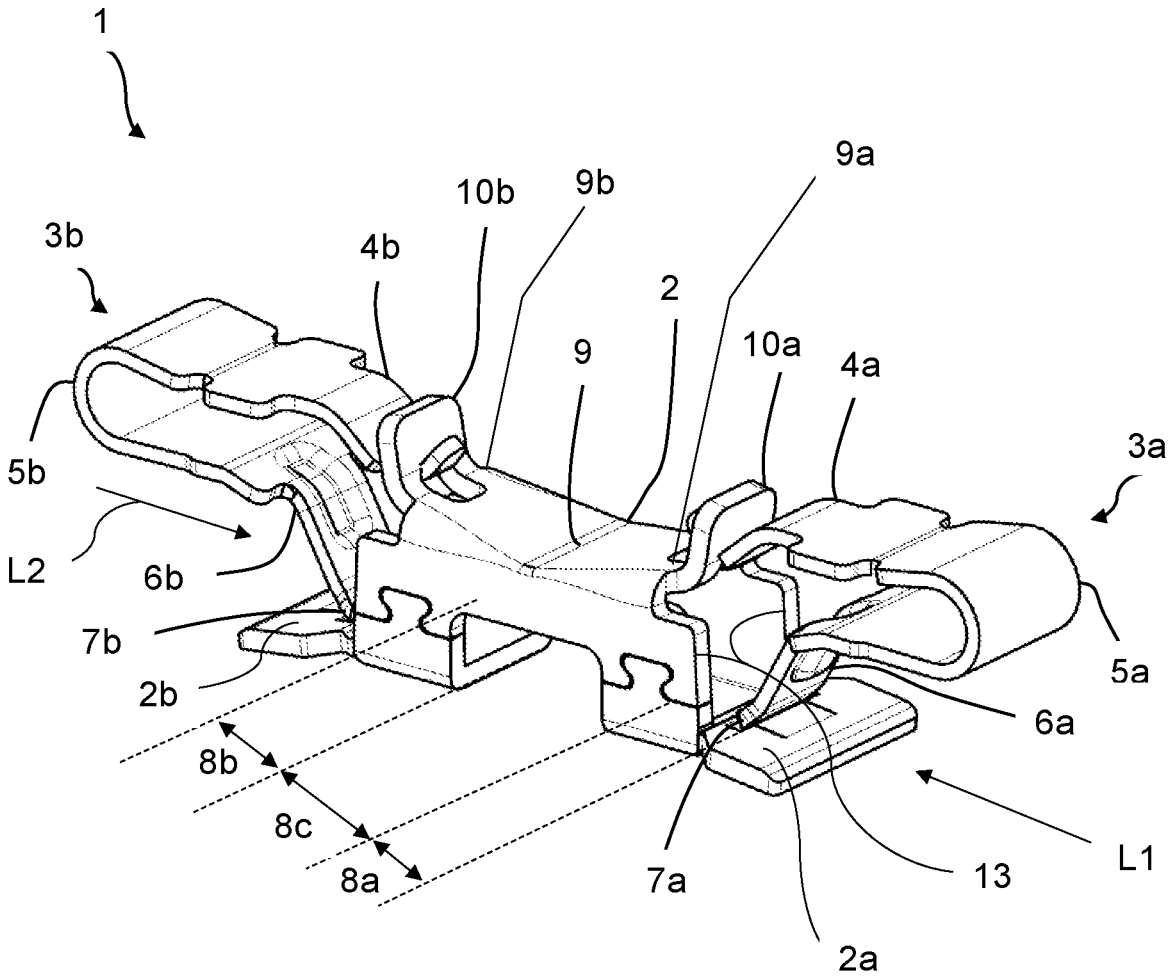
FIG. 1 shows an embodiment of a conductor connection terminal in a perspective view.

FIG. 1 shows a conductor connection terminal 1 in a perspective view in a first embodiment. The conductor connection terminal 1 has a busbar component 2, wherein in each case a first clamping spring 3*a* and a second clamping spring 3*b* are arranged at the diametrically opposite ends of the busbar component 2. The clamping springs 3*a*, 3*b* each have a contact leg 4*a*, 4*b* which merges into a spring arc 5*a*, 5*b* and extends into a clamping leg 6*a*, 6*b*. The clamping leg 6*a*, 6*b* thereby extends to a section of the busbar component 2, wherein the clamping leg 6*a*, 6*b* has a spring clamping edge 7*a*, 7*b* and forms with the busbar component 2 a first clamping point for a first electrical conductor to be clamped and a second clamping point for a second electrical conductor to be clamped.

It can be seen that a first conductor receiving section 8*a* for the first electrical conductor to be clamped and a second conductor receiving section 8*b* for the second electrical conductor to be clamped are arranged at the diametrically opposite ends of the busbar component 2, respectively. It is clear that the conductor receiving sections 8*a*, 8*b* are made to be circumferentially closed. The conductor receiving sections 8*a*, 8*b* comprise a top section 9*a*, 9*b* of a top surface 9 associated with the contact leg 4*a*, 4*b* and a bottom section 12 associated with the spring clamping edge 7*a*, 7*b*, wherein the respective top section 9*a*, 9*b* and the bottom section 12 are connected to one another via two side surfaces 13 and form a contiguous conductor receiving section 8*a*, 8*b* which is circumferentially closed. The conductor receiving sections 8*a*, 8*b* are thereby connected to one another via a connecting section 8*c*, wherein the conductor receiving sections 8*a*, 8*b* and the connecting section 8*c* comprise the common top surface 9.

Viewed in a first conductor insertion direction L1 or a second conductor insertion direction L2 upstream of the conductor receiving sections 8*a*, 8*b*, the busbar component 2 comprises a preferably integrally formed tab-shaped conductor contact section 2*a*, 2*b*, on which, in the closed state without an inserted electrical conductor, the spring clamping edge 7*a*, 7*b* preferably rests.

It can also be seen that two fastening tabs 10*a*, 10*b* are arranged on the top surface 9 of the busbar component 2, wherein the fastening tabs 10*a*, 10*b* are arranged at diametrically opposite ends of the top surface 9. One of the clamping springs 3*a*, 3*b* is suspended in each of the fastening tabs 10*a*, 10*b* in a self-supporting manner, i.e. without additional fasteners.

However, it is also conceivable that the clamping springs 3*a*, 3*b* are formed as a single clamping spring with two clamping legs 7*a*, 7*b*, wherein the single clamping spring extends along the top surface 9 of the busbar component 2.

Figure 2A:
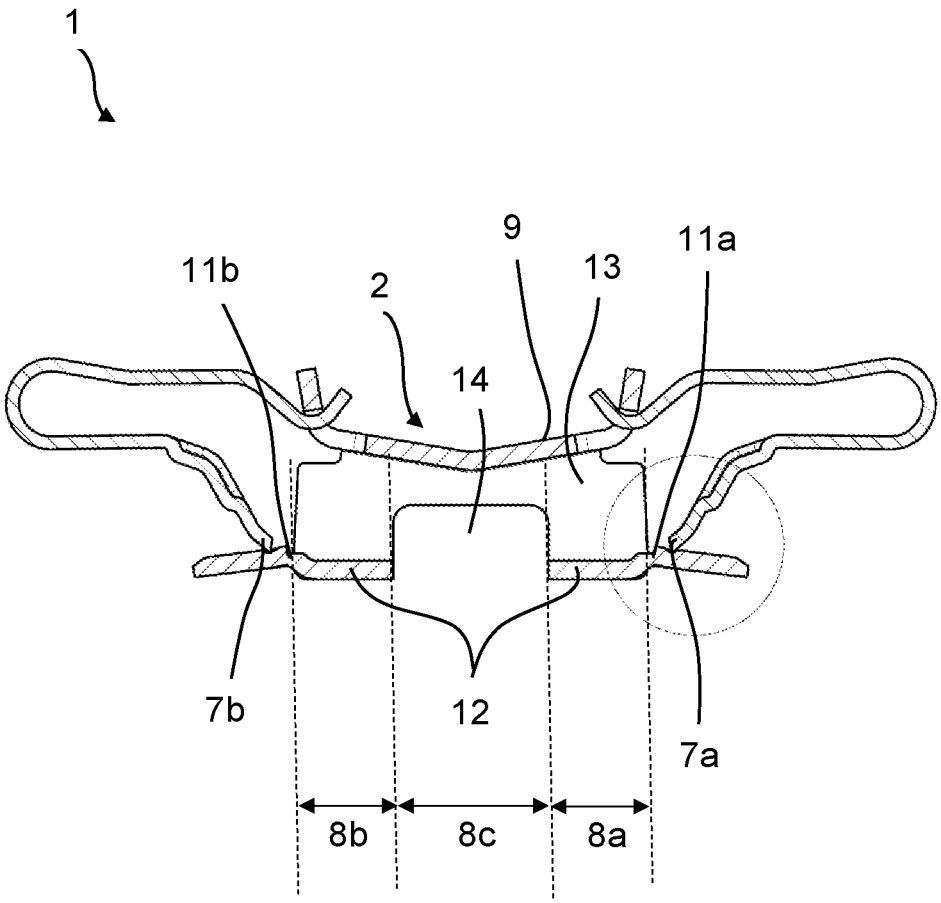
FIG. 2*a* shows a conductor connection terminal according to FIG. 1 in a sectioned side view without inserted electrical conductor.

FIG. 2*a* shows a conductor connection terminal 1 according to FIG. 1 in a sectioned side view without an inserted electrical conductor. It can be seen that the busbar component 2 has in each case a busbar clamping edge 11*a*, 11*b* in the area of the spring clamping edges 7*a*, 7*b*. The busbar clamping edges 11*a*, 11*b* can advantageously be provided in the area of the conductor contact sections 2*a*, 2*b*. The busbar clamping edges 11*a*, 11*b* have a radius smaller than or equal to 0.2 mm, in particular a radius smaller than or equal to 0.1. By forming the busbar clamping edge 11*a*, 11*b* with a very small radius, a conductor connection terminal 1 is provided which has a large conductor holding force. By forming the busbar clamping edge 11*a*, 11*b* with a small radius, the busbar clamping edges 11*a*, 11*b* are formed to be so sharp that they can cut into an electrical conductor to be clamped, and thus the busbar clamping edge 11*a*, 11*b* digs into the electrical conductor to be clamped, wherein a corresponding conductor holding force can be achieved.

However, it is also conceivable that the busbar clamping edges 11*a*, 11*b* have even smaller radii. This further improves the effect of cutting into the electrical conductor.

It can further be seen that the bottom section 12 of the busbar component 2 can form a support for the electrical conductors to be clamped. The bottom section 12 can thereby comprise the tab-shaped conductor contact sections 2*a*, 2*b*. The bottom section 12 and the top surface 9 are thereby connected to each other via two opposite side surfaces 13. It is clear that bottom section 12 and side surfaces 13 have a recess 14 in the area of the connecting section 8*c*. The recess 14 is thereby arranged substantially central between the first conductor receiving section 8*a* and the second conductor receiving section 8*b*. Substantially central means that the recess 14 is arranged such that the conductor receiving sections 8*a*, 8*b* have the same length. Deviations of up to 15% are possible.

The recess 14 extends over half of the connecting section 8*c*. The half here refers to the area that the recess 14 occupies in the side view. The busbar component 2 is formed in a U-shape in cross section by the recess 14 extending over the bottom section 12 and both side surfaces 13. The U-shaped configuration can ensure a good current flow and a stable conductor connection terminal 1.

It is further evident that the top surface 9 is designed as a conductor run-up chamfer, wherein the top surface 9 is V-shaped. In this case, the cross section of the conductor receiving sections 8*a*, 8*b* tapers towards the center of the conductor connection terminal 1 up to the area of the connecting section 8*c*. In this way, a corresponding electrical conductor can be inserted into the larger cross section of the conductor receiving sections 8*a*, 8*b*, wherein the electrical conductor can be guided through the tapering cross section towards the respective clamping point.

Figure 2B:
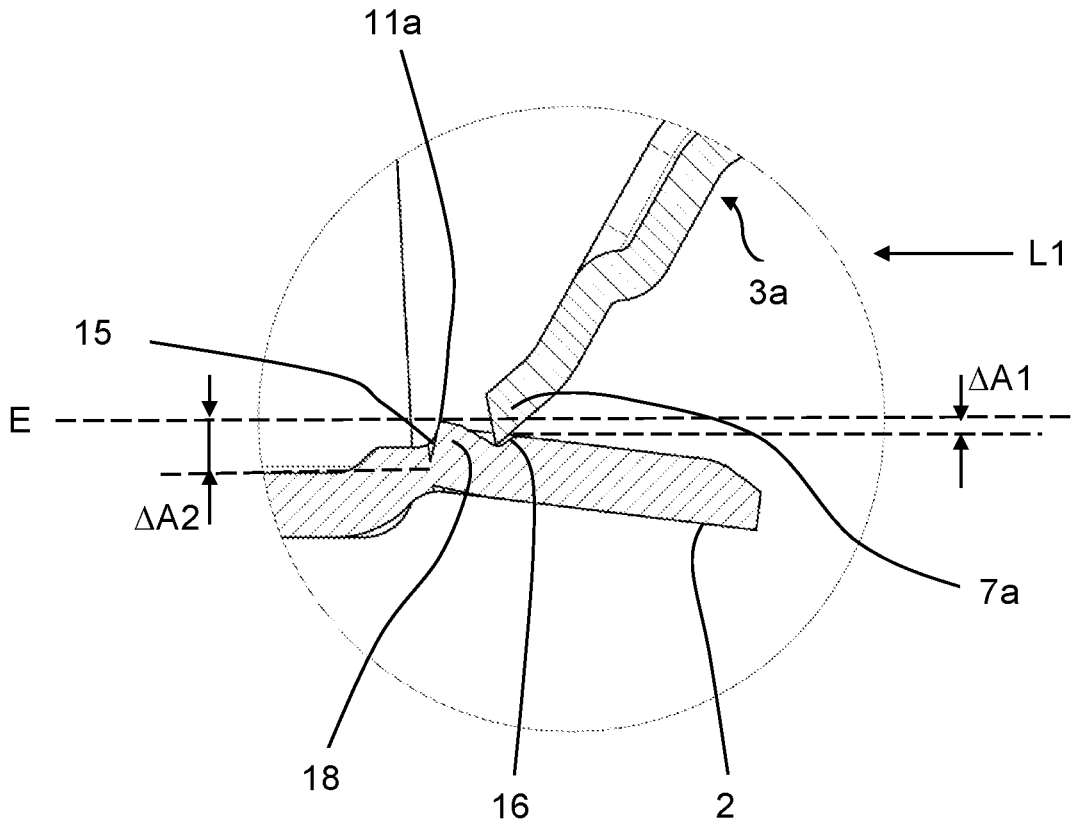
FIG. 2*b* shows an enlarged section of a conductor connection terminal according to FIG. 2*a;*

FIG. 2*b* shows an enlarged section of the conductor connection terminal 1 according to FIG. 2*a*. The area around the busbar clamping edge 11*a* is shown enlarged. This would make clear that the busbar clamping edge 11*a* is arranged on a busbar clamping section 18. The busbar clamping section 18 is cut or punched out of the busbar component 2.

It can further be seen that the busbar component 2 has a dip 15 and a depression 16, wherein the dip 15 is arranged downstream of the busbar clamping edge 11*a* with respect to the first conductor insertion direction L1 and the depression 16 is arranged upstream of the busbar clamping edge 11*a* with respect to the first conductor insertion direction L1. The depression 16 is formed in such a way that it can receive the spring clamping edge 7*a* when no electric conductor is inserted in the conductor connection terminal 1. In this way, the clamping spring 3*a* can be further stabilized, wherein the transport safety of the conductor connection terminal 1 can be increased.

By means of the dip 15, a busbar clamping edge 11*a* can be created at a sufficient height in relation to the busbar so that the busbar clamping edge 11*a* can be embedded into the electrical conductor to be clamped at this height. However, care must be taken to limit the height, as otherwise damage may occur to the electrical conductor to be clamped.

Furthermore, it is clear that the distance ΔA2 between a plane E extending through the busbar clamping edge 11*a* and parallel to the first conductor insertion direction L1 and the busbar 2 is greater behind the busbar clamping edge 11*a* than the distance ΔA1 upstream of the busbar clamping edge 11*a*.

Figure 3A:
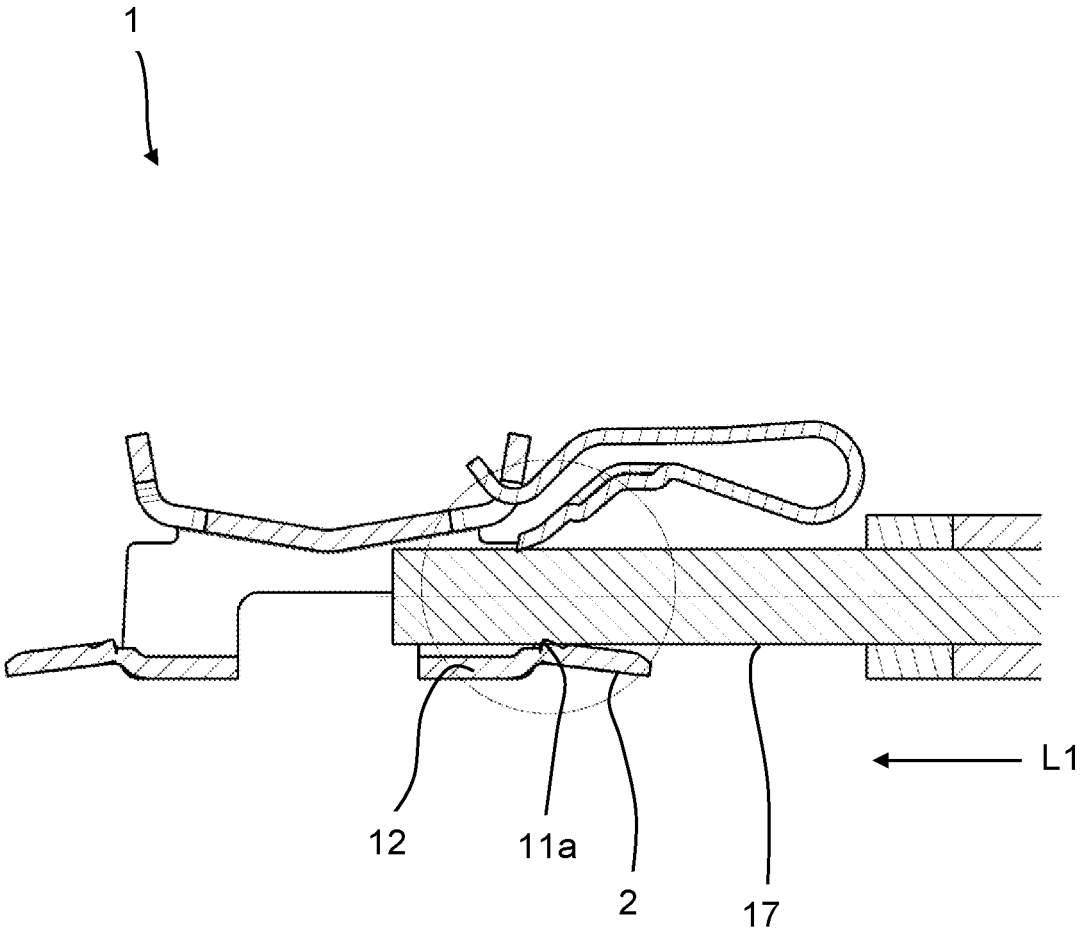
FIG. 3*a* shows a conductor connection terminal according to FIGS. 1-2*b* in a sectioned side view with inserted electrical conductor.
Figure 3B:
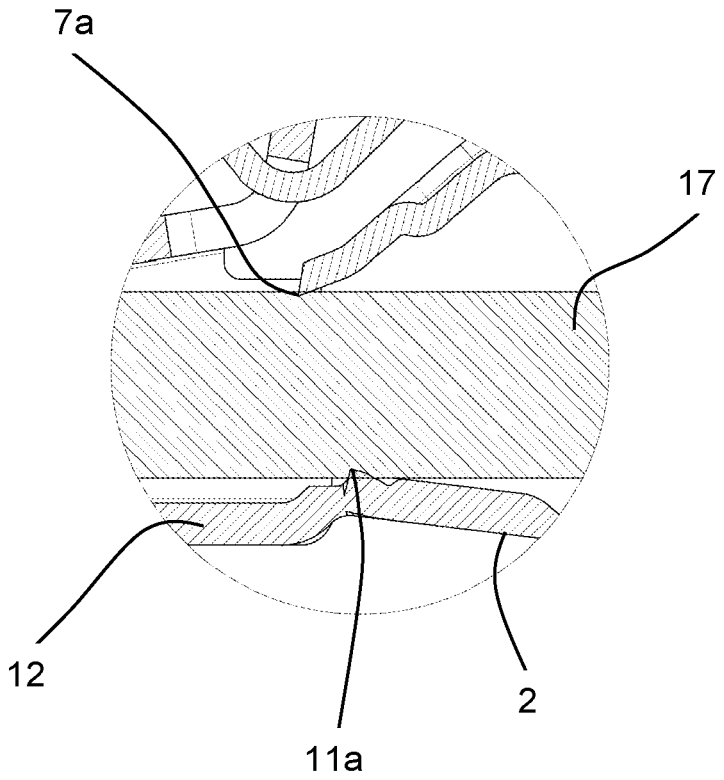
FIG. 3*b* shows an enlarged section of a conductor connection terminal according to FIG. 3*a*.

FIG. 3*a* shows a conductor connection terminal 1 according to FIGS. 1-2*b* in a sectioned side view with an inserted first electrical conductor 17. FIG. 3*b* shows an enlarged section of the conductor connection terminal 1 according to FIG. 3*a*. In this case, the area around the busbar clamping edge 11*a* is shown enlarged.

It is clear that the first electrical conductor 17 is held clamped between the spring clamping edge 7*a* and the busbar clamping edge 11*a* on the bottom section 12 of the busbar component 2. The busbar clamping edge 11*a* is thereby formed as a hook, wherein the busbar clamping edge 11*a* cuts into the first electrical conductor 17 in the opposite direction of the first conductor insertion direction L1 when the first electrical conductor 17 is pulled, and thus is embedded into the first electrical conductor 17. In this way, a correspondingly high holding force can be exerted on the first electrical conductor 17, wherein the first electrical conductor 17 can be held fixed in the clamping point of the conductor connection terminal 1.

A second electrical conductor could be clamped in the same way to the diametrically opposite end of the clamped first electrical conductor 17.

The busbar clamping edge 11*a* can thereby be designed more rigid than the spring clamping edge 7*a*. The increased rigidity of the busbar clamping edge 11*a* as compared to the spring clamping edge 7*a* can ensure that the busbar clamping edge 11*a* cuts into the electrical conductor to be clamped.

Figure 4:
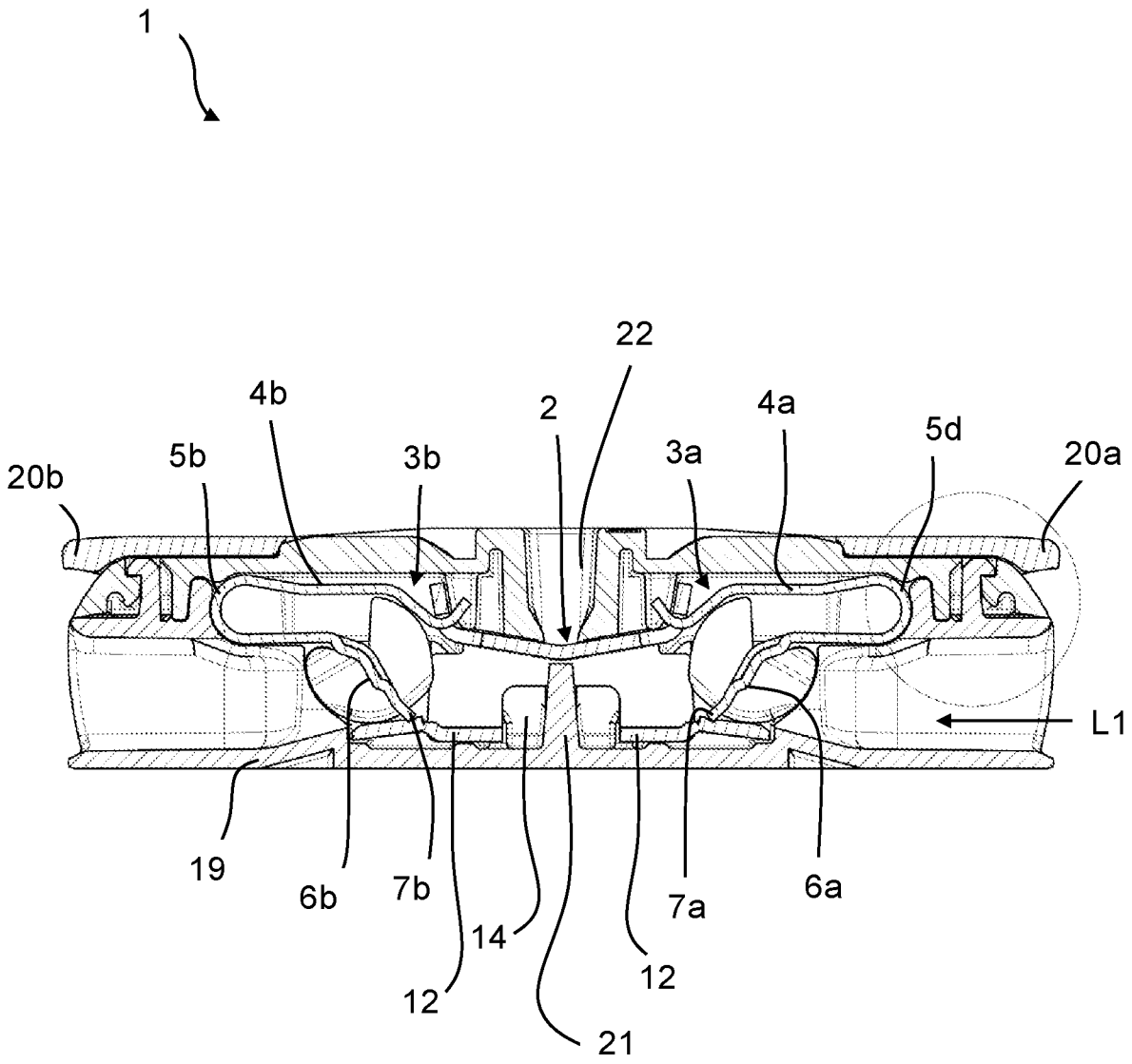
FIG. 4 shows a conductor connection terminal with an insulating material housing in a side sectional view.

FIG. 4 shows a conductor connection terminal 1 with an insulating material housing 19 in a sectioned side view with a busbar component 2 arranged in the insulating material housing 19. Two clamping springs 3*a*, 3*b* are arranged on the busbar component 2 at diametrically opposite ends. The clamping springs 3*a*, 3*b* have a contact leg 4*a*, 4*b* which merges into a spring arc 5*a*, 5*b* and extends into a clamping leg 6*a*, 6*b*. The clamping legs 6*a*, 6*b* each have a spring clamping edge 7*a*, 7*b*, wherein the spring clamping edges 7*a*, 7*b* form a first clamping point with the busbar component 2 for a first electrical conductor to be clamped and a second clamping point for a second electrical conductor to be clamped.

The conductor connection terminal 1 has two actuating levers 20*a*, 20*b*, wherein one actuating lever 20*a*, 20*b* interacts with a clamping spring 3*a*, 3*b* respectively so that the actuating levers 20*a*, 20*b* are arranged to deflect the clamping legs 6*a*, 6*b*. The clamping points for the electrical conductors can be opened and/or closed by the actuating levers.

It is further clear that the conductor connection terminal 1 has a conductor stop 21, wherein the conductor stop 21 is arranged on the insulating material housing 2. The conductor stop serves to position the first electrical conductor to be clamped and the second electrical conductor to be clamped, wherein the conductor stop 21 is arranged in the area of the recess 14 of the busbar component 2. The conductor stop 21 is thereby guided through the recess 14 in the bottom section 12 of the busbar component 2. In an advantageous embodiment, the insulating material housing 19 is transparent at least in the area of the recess 14. By forming a transparent insulating material housing, a way to check the insertion depth of the electrical conductors to be clamped is created, wherein the user can actively check whether the respective electrical conductor is positioned at the conductor stop 21 by means of the insulating material housing 19.

A test opening 22 is arranged on the conductor connection terminal 1, wherein the test opening 22 extends from the surface of the insulating material housing 19 through the insulating material housing 19 towards the busbar component 2. The test opening 22 extends transversely, in particular orthogonally, to the first conductor insertion direction L1. Through the test opening 22, the busbar component 2 can be contacted with external measuring devices, for example.

The invention being thus described, it will be obvious that the same may be varied in many ways. Such variations are not to be regarded as a departure from the spirit and scope of the invention, and all such modifications as would be obvious to one skilled in the art are to be included within the scope of the following claims.

What is claimed is:

1. A conductor connection terminal comprising:

an insulating material housing;

a busbar component;

a first clamping leg; and a second clamping leg, wherein the first clamping leg and the second clamping leg are arranged on different clamping springs, respectively, wherein the first clamping leg and the busbar component form a first clamping point for a first electrical conductor to be clamped, and the second clamping leg and the busbar component form a second clamping point for a second electrical conductor to be clamped, wherein the busbar component comprises a first conductor receiving section and a second conductor receiving section at diametrically opposite areas of one another, wherein the first conductor receiving section and the second conductor receiving section are connected to one another via a connecting section, wherein the first electrical conductor is adapted to be fed to the first clamping point via the first conductor receiving section in a first conductor insertion direction and the second electrical conductor is adapted to be fed to the second clamping point via the second conductor receiving section in a second conductor insertion direction, wherein the busbar component has a bottom section comprising the first and second clamping points, a top surface and two opposing side surfaces which connect the bottom section to the top surface, wherein the first conductor receiving section and the second conductor receiving section are designed to be closed circumferentially, wherein the connecting section has at least one recess within the bottom section, and wherein the top surface is designed as a conductor run-up chamfer.

2. The conductor connection terminal according to claim 1, wherein the busbar component has fastening tabs for fastening the clamping springs to the bus bar component.

3. The conductor connection terminal according to claim 1, wherein the at least one recess of the connecting section is arranged substantially central between the first conductor receiving section and the second conductor receiving section.

4. The conductor connection terminal according to claim 1, wherein the clamping springs include a first clamping spring and a second clamping spring, the first clamping spring having a contact leg, the first clamping leg and a spring arc arranged between the contact leg and the first clamping leg, and wherein the first clamping leg extends towards the busbar component and has a spring clamping edge for clamping the first electrical conductor, wherein the second clamping spring has a contact leg, the second clamping leg and a spring arc arranged between the contact leg and the second clamping leg, and wherein the second clamping leg extends towards the busbar component and has a spring clamping edge for clamping the second electrical conductor.

5. The conductor connection terminal according to claim 1, wherein the conductor connection terminal has an actuating lever, wherein the actuating lever is arranged for deflecting the first clamping leg or the second clamping leg.

6. The conductor connection terminal according to claim 1, wherein the at least one recess is closed by the insulating material housing.

7. The conductor connection terminal according to claim 1, wherein a conductor stop is arranged on the conductor connection terminal for the positioning of the first electrical conductor to be clamped and/or the second electrical conductor to be clamped, and wherein the conductor stop is arranged in the area of the at least one recess.

8. The conductor connection terminal according to claim 7, wherein the conductor stop is arranged on the insulating material housing.

9. The conductor connection terminal according to claim 7, wherein the insulating material housing is transparent at least in the area of the conductor stop, such that the conductor stop is seen through the insulating material housing.

10. A conductor connection terminal comprising:

an insulating material housing;

a busbar component;

a first clamping leg; and a second clamping leg, wherein the first clamping leg and the second clamping leg are arranged on different clamping springs, respectively, wherein the first clamping leg and the busbar component form a first clamping point for a first electrical conductor to be clamped, and the second clamping leg and the busbar component form a second clamping point fora second electrical conductor to be clamped, wherein the busbar component comprises a first conductor receiving section and a second conductor receiving section at diametrically opposite areas of one another, wherein the first conductor receiving section and the second conductor receiving section are connected to one another via a connecting section, wherein the first electrical conductor is adapted to be fed to the first clamping point via the first conductor receiving section in a first conductor insertion direction and the second electrical conductor is adapted to be fed to the second clamping point via the second conductor receiving section in a second conductor insertion direction, wherein the busbar component has a bottom section comprising the first and second clamping points, a top surface and two opposing side surfaces which connect the bottom section to the top surface, wherein the first conductor receiving section and the second conductor receiving section are designed to be closed circumferentially, wherein the connecting section has at least one recess within the bottom section, and wherein the at least one recess extends over the side surfaces.

11. The conductor connection terminal according to claim 10, wherein the busbar component is U-shaped in a cross section substantially perpendicular to the first conductor insertion direction and/or to the second conductor insertion direction.

12. The conductor connection terminal according to claim 11, wherein the top surface is V-shaped in cross section in a direction of the first conductor insertion direction and/or the second conductor insertion direction.

13. A conductor connection terminal comprising:

an insulating material housing;

a busbar component;

a first clamping leg; and a second clamping leg, wherein the first clamping leg and the second clamping leg are arranged on different clamping springs, respectively, wherein the first clamping leg and the busbar component form a first clamping point for a first electrical conductor to be clamped, and the second clamping leg and the busbar component form a second clamping point for a second electrical conductor to be clamped, wherein the busbar component comprises a first conductor receiving section and a second conductor receiving section at diametrically opposite areas of one another, wherein the first conductor receiving section and the second conductor receiving section are connected to one another via a connecting section, wherein the first electrical conductor is adapted to be fed to the first clamping point via the first conductor receiving section in a first conductor insertion direction and the second electrical conductor is adapted to be fed to the second clamping point via the second conductor receiving section in a second conductor insertion direction, wherein the busbar component has a bottom section comprising the first and second clamping points, a top surface and two opposing side surfaces which connect the bottom section to the top surface, wherein the first conductor receiving section and the second conductor receiving section are designed to be closed circumferentially, wherein the connecting section has at least one recess within the bottom section, and wherein a test opening is arranged on the insulating material housing, wherein the test opening is aligned transversely with respect to the first electrical conductor to be clamped and/or transversely with respect to the second electrical conductor to be clamped and extends from the insulating material housing towards the busbar component.

14. A conductor connection terminal comprising:

an insulating material housing;

a busbar component;

a first clamping leg; and a second clamping leg, wherein the first clamping leg and the second clamping leg are arranged on different clamping springs, respectively, wherein the first clamping leg and the busbar component form a first clamping point for a first electrical conductor to be clamped, and the second clamping leg and the busbar component form a second clamping point for a second electrical conductor to be clamped, wherein the busbar component comprises a first conductor receiving section and a second conductor receiving section at diametrically opposite areas of one another, wherein the first conductor receiving section and the second conductor receiving section are connected to one another via a connecting section, wherein the first electrical conductor is adapted to be fed to the first clamping point via the first conductor receiving section in a first conductor insertion direction and the second electrical conductor is adapted to be fed to the second clamping point via the second conductor receiving section in a second conductor insertion direction, wherein the busbar component has a bottom section comprising the first and second clamping points, a top surface and two opposing side surfaces which connect the bottom section to the top surface, wherein the first conductor receiving section and the second conductor receiving section are designed to be closed circumferentially, wherein the connecting section has at least one recess within the bottom section, and wherein the busbar component has a support surface for the actuating lever.

* * * * *